US007485083B2

(12) United States Patent
Gaeta

(10) Patent No.: US 7,485,083 B2
(45) Date of Patent: Feb. 3, 2009

(54) TRAY

(75) Inventor: Stephen Anthony Gaeta, Flemington, NJ (US)

(73) Assignee: Unilever Bestfoods, North America, division of Conopco, Inc., Englewood Cliffs, NJ (US)

( * ) Notice: Subject to any disclaimer, the term of this patent is extended or adjusted under 35 U.S.C. 154(b) by 12 days.

(21) Appl. No.: 10/747,990

(22) Filed: Dec. 30, 2003

(65) Prior Publication Data

US 2005/0145684 A1 Jul. 7, 2005

(51) Int. Cl.
*B31B 1/25* (2006.01)
*B65D 5/28* (2006.01)

(52) U.S. Cl. ..... 493/59; 229/109; 229/164; 493/56

(58) Field of Classification Search ..... 229/109, 229/164, 190, 108, 110, 918; 206/427; 493/56, 493/59, 60, 61, 62
See application file for complete search history.

(56) References Cited

U.S. PATENT DOCUMENTS

| | | | | | |
|---|---|---|---|---|---|
| 204,022 | A * | 5/1878 | Gibson | 229/109 |
| 3,784,082 | A * | 1/1974 | Hurlock | 229/190 |
| 4,391,371 | A | 7/1983 | Sieffert | |
| 4,417,686 | A | 11/1983 | Wozniacki | |
| 4,427,108 | A * | 1/1984 | Coles et al. | 229/164 |
| 4,792,084 | A * | 12/1988 | Dreeszen | 229/109 |
| 4,998,615 | A * | 3/1991 | Bryan | 229/164 |
| 5,372,299 | A * | 12/1994 | Edgerton et al. | 229/918 |
| D361,892 | S | 9/1995 | Quaintance | |
| 5,487,504 | A * | 1/1996 | Baird | 229/164 |
| 5,752,648 | A | 5/1998 | Quaintance | |
| 5,950,911 | A * | 9/1999 | Naughton et al. | 229/109 |
| 6,027,017 | A * | 2/2000 | Kuhn et al. | 229/164 |
| 6,223,978 | B1 | 5/2001 | Drager | |
| 6,283,363 | B1 * | 9/2001 | Focke | 229/164 |
| 6,394,742 | B1 * | 5/2002 | Buscema | 229/918 |
| 6,464,106 | B1 | 10/2002 | Giblin et al. | |
| 2003/0019920 | A1 | 1/2003 | Quaintance | |
| 2003/0150764 | A1 * | 8/2003 | Bevier | 229/918 |

FOREIGN PATENT DOCUMENTS

| | | |
|---|---|---|
| FR | 2 722 074 | 1/1996 |
| FR | 2 780 703 | 7/1998 |
| FR | 2 810 968 | 5/2001 |

OTHER PUBLICATIONS

Eagle Custom Packaging Systems Internet website: www.eaglecustompackaging.com/SELFLOCK-ns4.html.
Meta Systems website: www.smurfit-stne.com/content/meta system.asp.
International Search Report on Application No. on PCT/EP 2004/014158 dated Mar. 31, 2005.
Structural Options website (10 pages): www.correllconcepts.com/Pizza_Packaging/structural%20_options.htm.
Square vs. Non-square website (4 pages): www.correllconcepts.com/Pizza_Packaging/square_non-square.htm.
Purchasing.com website (5 pages) "Read, rant, and rate these articles", Jul. 26, 2005.
Packaging Digest website (6 pages): www.packagingdigest.com/articles/200207/99.php.

* cited by examiner

*Primary Examiner*—Gary E Elkins
(74) *Attorney, Agent, or Firm*—Gerard J. McGowan, Jr.

(57) ABSTRACT

A new, readily manufactured display tray having at least 5 sides, and preferably at least 8 sides, a blank therefor and processes for making and erecting the blank. The tray of the invention enjoys the sometime reported benefits of trays having numerous corners yet is more readily manufactured than the typical 8-sided cases disclosed in the prior art. In addition, the tray of the invention requires less corrugated board or other packaging material than the typical prior art 8-sided case.

2 Claims, 4 Drawing Sheets

TRAY

BACKGROUND OF THE INVENTION

Twin, closely related themes which are familiar to employees of manufacturing companies are: "reduce costs" and "conserve resources." Obviously, the two mandates are not mutually exclusive.

Packages with increased compressive strength attributable to an increase in the number of corners are known. For instance, a lightweight octagonal bottle is known from Giblin et al. U.S. Pat. No. 6,464,106. One advantage of increased compressive strength is that the amount of material used in the package may be minimized, thereby conserving resources and lowering cost.

Octagonal cartons and trays are also known. As with bottles, a reported advantage is to increase compressive strength and to permit minimization of packaging materials used in the walls of the container. Unfortunately, octagonal cartons and trays can be difficult to make and utilize significant amounts of packaging resources.

Quaintance US Patent Application Publication No. US 2003/0019920 is directed to a container having more than four sides and constructed to have improved stacking strength and resistance to distortion when transverse forces are applied to the ends or sides of the tray. Embodiments with eight sides are disclosed. Prior art eight sided boxes or trays are said to be formed from a unitary blank of corrugated paperboard.

Drager U.S. Pat. No. 6,223,978 discloses an octagonal package, especially for round items such as pizza. Drager mentions that round packages are available but that many of these have weak vertical structural strength which is said to limit the stackability of the packages because they cannot support the weight of several packages stacked onto each other. The Drager octagonal package includes a bottom and a cover hinged thereto. The cover includes side walls and a locking flap for securing the cover in the closed position onto the bottom. The bottom includes two side walls, a front wall and a rear wall, as well as bridging panels which hingedly interconnect the front wall and the rear wall to each side wall. The bridging panels fold into corners providing vertical structural strength and cause the rear, front and side walls to erect as a unit.

Quintance U.S. Pat. No. Des. 361,892 discloses an eight-sided poultry box.

Wozniacki U.S. Pat. No. 4,417,686 is directed to a tray with extensions which serve as corner reinforcements to prevent buckling.

Meech U.S. Pat. No. 495,421 is directed to a fruit box. The box has 6 or more sides.

Quaintance U.S. Pat. No. 5,752,648 discloses a web-bottomed eight sided tray.

Sieffert U.S. Pat. No. 4,391,371 discloses a fiberboard container for the shipment of fragile and irregularly shaped articles. The container may include a sleeve having an octagonal shape.

Eagle Custom Packaging Systems Internet website, www.eaglecustompackaging.com/SELFLOCK-ns4.html discloses an octagon self locking tray erector and an octagonal self locking tray and blank.

Eight corner containers are produced on Meta Systems' machines which are HSC (half slotted cartons) box formers. Meta Systems equipment can be found at www.smurfitstone.com/content/meta system.asp.

Despite the disclosure of several 8-sided cartons in the literature, there is still a need for an 8-sided carton which can be readily erected.

SUMMARY OF THE INVENTION

The present invention is directed to the discovery of a new, readily manufactured display tray having at least 5 sides, and preferably at least 8 sides, and a carton blank therefor. The tray of the invention comprises a bottom panel having an upper surface, a lower surface and at least five generally rectilinear sides, front and rear walls each extending upwardly from one of the bottom panel sides and separated therefrom by scorelines, side walls extending upwardly from at least two other of the bottom panel sides and separated therefrom by scorelines, and at least one oblique side panel extending upwardly from the bottom panel but not being directly connected thereto. The bottom of each side wall is generally coextensive with one of the bottom panel sides, and the maximum height of at least one of the front and rear walls does not extend to the maximum height of the side walls, whereby to facilitate viewing of the interior of the display case.

The tray of the invention enjoys the sometime reported benefits of trays having numerous corners yet is more easily manufactured than the typical 8-sided cases disclosed in the prior art. In addition, the tray of the invention requires less corrugated board or other packaging material than the typical prior art 8-sided case.

The blank for forming the tray of the invention comprises a central bottom panel having an upper surface, a lower surface and at least five generally rectilinear sides, a front panel separated from a first of said sides by a first scoreline, a rear panel opposite said front panel and separated by a second scoreline from a second of said sides, a first side panel, separated from a third of said bottom panel sides by a third scoreline, said third scoreline being generally perpendicular to said first scoreline, and a second side panel separated from a fourth side of said central bottom panel by a fourth scoreline, the fourth scoreline being opposite said third scoreline. The first side panel is separated from a pair of first and second oblique side panels on opposite sides thereof by first and second oblique side panel scorelines, the first side panel sides being generally perpendicular to said third scoreline, the first and second oblique panel scorelines each having an attachment panel extending therefrom on a side opposite the first side panel, the second side panel is separated from a pair of third and fourth oblique side panels on opposite sides thereof by third and fourth oblique side panel scorelines, the second side panel sides being generally perpendicular to the fourth scoreline. The third and fourth oblique panel scorelines each have an attachment panel extending therefrom on a side opposite the third side panel, the oblique side panels not being attached to the bottom central panel except indirectly through the side panels.

The blank of the invention uses less corrugated board than prior art HSC (half slotted carton) eight-sided trays and is more readily erected to form the tray.

The invention is also directed to processes of making a carton blank and of erecting the display tray. The process of making a carton blank starts with a standard slotted tray blank which is modified, in accordance with the invention, by addition of an additional scoreline at each corner. In addition, the standard slotted tray blank is modified by cutting away the corners of the bottom panel to provide at least five, and preferably eight, generally rectilinear sides and by cutting away portions of the front and rear flaps so that they are coextensive with the shortened rectilinear sides to which they are attached. The modifications result in use of less board. Moreover, the blank can be erected using standard tray forming equipment with minor modifications, if needed.

Existing tray forming/loading equipment forms four corner trays by using mechanical plows and tuckers to fold and glue flaps at right angles. The present invention alters the forming and the tucking mechanism to plow the tray sides upward but then form the tray corners in two steps. The first fold occurs at 45 deg. The second an additional 45 degrees of motion. A mechanical device not limited to an articulating arm, rotating tucker or air piston would be added to partially fold in the first motion a flap with two scores. The second score would be tucked to complete the folding process in the same manner after glue has been applied. The modification will result in the addition of one flap tucking device on each side of the machine.

Tray blank magazines, vacuum cups, glue applicators would be adjusted and positioned as needed to accommodate the redesigned blank.

The present forming tray process represents an improvement over the existing technology in that the eight corner tray can be formed and loaded on one machine much the same as the process to form a four corner tray or box. As stated the tray to be formed uses significantly less corrugated board and is carried out in one operation rather than two.

A blank of the invention resting flat may be erected using standard tray forming equipment by raising the side panels so that they are generally perpendicular to the bottom central panel, then folding each side panel at three fold lines on each side, raising the front and rear panels so that they are generally perpendicular to the central bottom panel, and adhering the front and rear panels to attachment flaps which extend from each of the side panels, to create an erected tray.

For a more complete of the above and other features and advantages of the invention, reference should be made to the following description of the preferred embodiment.

DETAILED DESCRIPTION OF THE INVENTION

Figure 1:
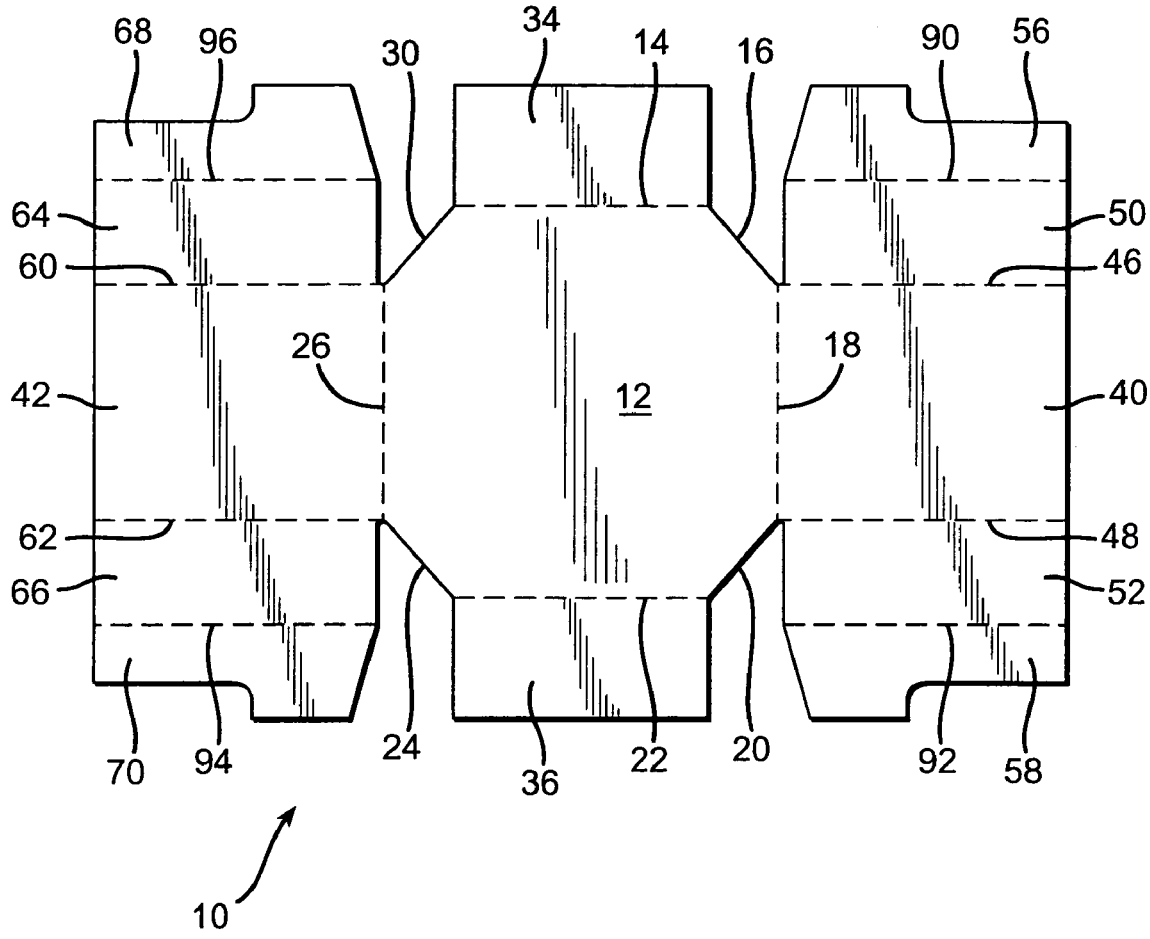
FIG. 1 is a top plan view of a blank according to the invention.

As seen in FIG. 1, blank 10 includes central bottom panel 12 having eight sides, 14, 16, 18, 20, 22, 24, 26 and 30. Pairs of sides of 14, 22; 16, 24; 18, 26; and 20, 30; are parallel to each other. Sides 14 and 22 of panel 12 are separated by scorelines from front panel 34 and rear panel 36. Separated by scorelines from sides 18 and 26 are first side panel 40 and second side panel 42 opposite thereto.

First side panel scorelines 46 and 48 separate first side panel 40 from oblique panels 50 and 52 on either side of the first side panel. "Oblique" refers to the fact that these extend diagonally to panels on either side when the carton is erected. Extending from oblique panels 50 and 52 on sides opposite the first side panel 40 are attachment panels 56 and 58.

Scorelines 60 and 62 separate second side panel from third and fourth oblique panels 64 and 66. Extending on sides opposite the second side panel 42 from oblique panel 64 and 66, respectively, are attachment panels 68 and 70.

Figure 3:
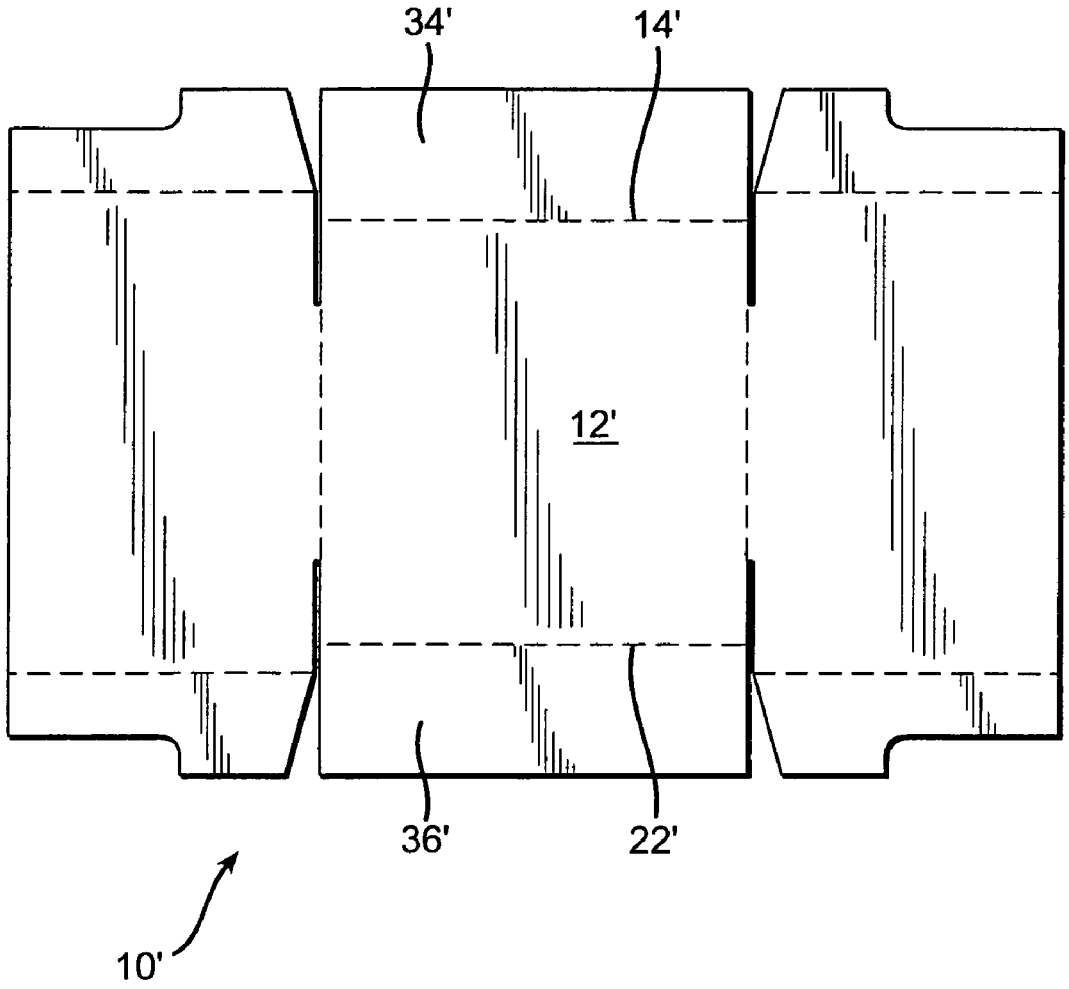
FIG. 3 is a top plan view of a blank suitable for making a prior art tray.

Carton blank 10 may be formed from standard carton blank 10' by cutting sides 30, 16, 20 and 24 (FIG. 1) to make bottom central panel 12 eight sided and by removing portions of front and rear panels 34 and 36 to make the panels coextensive with sides 14 and 22. Furthermore, the addition of scorelines 46, 48, 62 and 60 to the standard blank 10' of FIG. 3 permits formation of oblique panels 50, 52, 66 and 64 and, therefore, eight sided walls.

Blank 10 is erected into a display tray, preferably by using standard tray forming equipment, by raising side panels 40 and 42 so that they are generally perpendicular to bottom panel 12, then folding first and second side panels at foldlines 90, 46, 48, 92, 94, 62, 60 and 96. The front and rear panels are then raised so that they are generally perpendicular to the central bottom panel. Attachment flaps 56, 68 and 58, 70 are then adhered respectively to front panel 34 and rear panel 36 as by glue, hot melt or any other suitable adhering substance. The result is display tray 100 of FIG. 2.

Figure 2:
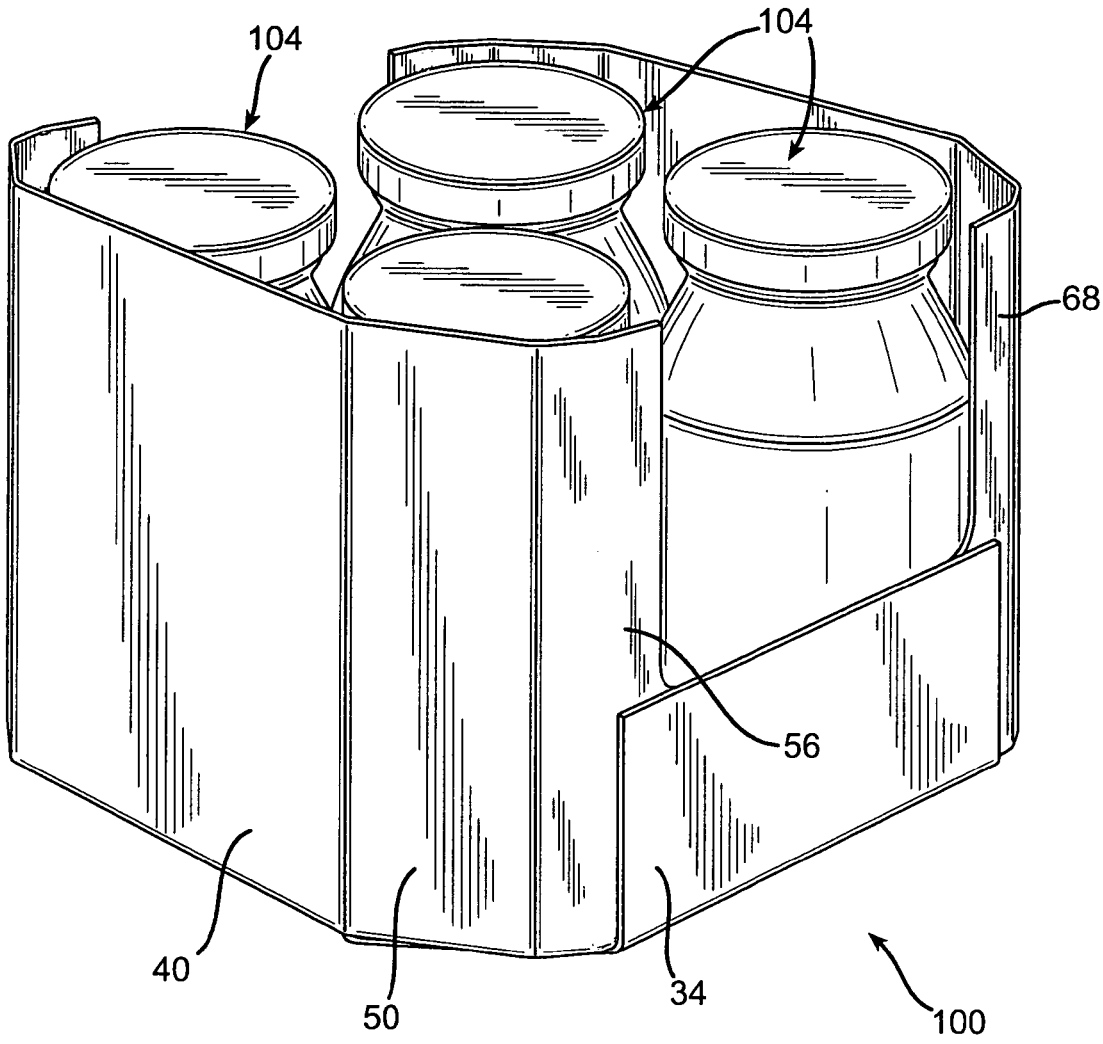
FIG. 2 is a perspective view of an erected tray according to the invention made from the blank of FIG. 1.

In FIG. 2 can be seen, e.g., front panel 34, attachment panels 56 and 68, oblique panel 50 and first side panel 40. Also visible are mayonnaise jars 104, although the tray may be used to contain other suitable individual packages and products. The tray is especially useful for products which have, or have been modified to have, low compressive strength. The improved compressive strength of the multi-sided structure of the present tray helps compensate for any deficiency in compressive strength of the individual packages contained therein. Also, trays having many sides illustrated herein, may better accommodate packages which are round, curved or which have themselves many sides.

As can be seen in FIG. 2, to facilitate display of containers 104, the maximum heights of front panel 34 and attachment panel 56 are less than 75% that of side panel 40.

Figure 4:
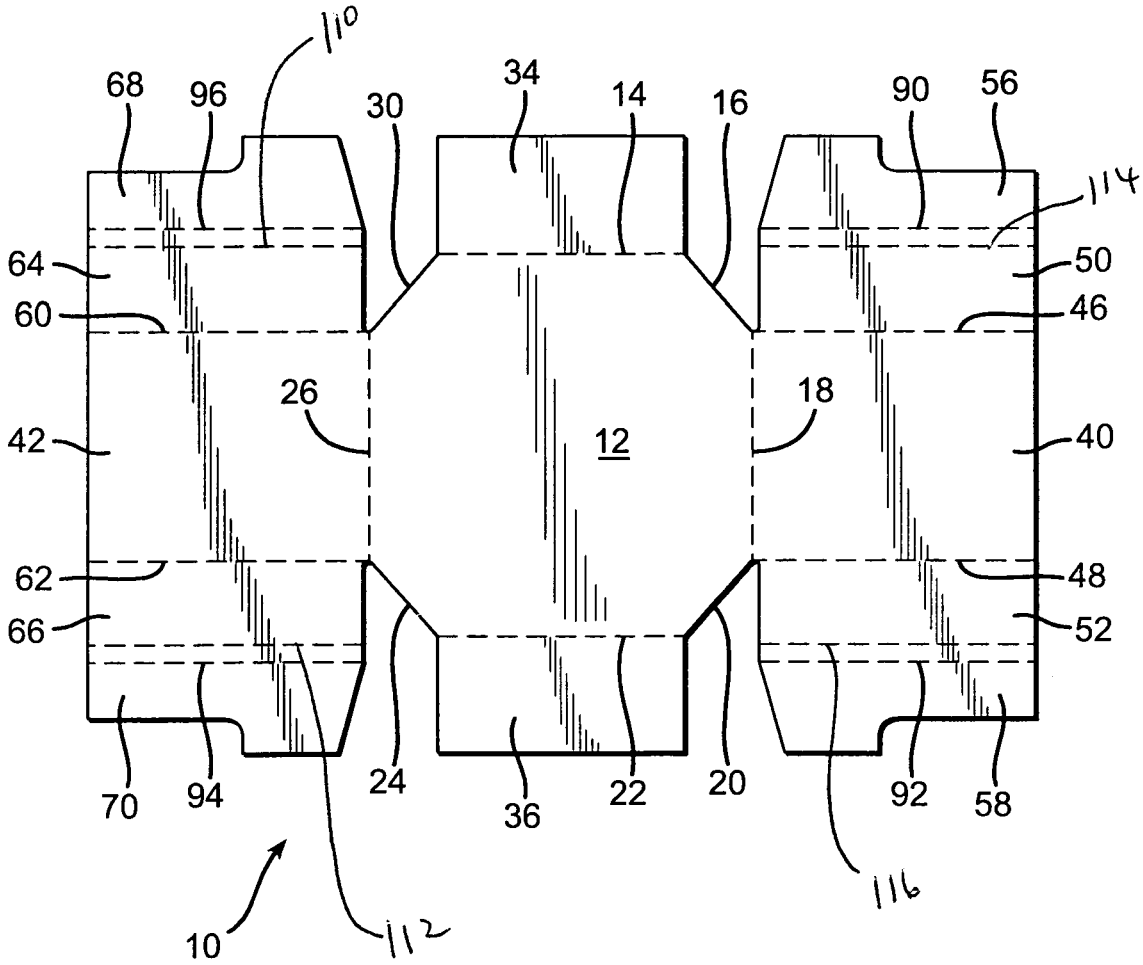
FIG. 4 is a view similar to FIG. 1 of an alternative embodiment.

The embodiment of FIG. 4 is similar to that of FIG. 1, except that additional scorelines 110, 112, 114 and 116 have been imposed adjacent to scores 110, 112, 114 and 116 for folding the blank.

It should be understood of course that the specific forms of the invention herein illustrated and described are intended to be representative only, as certain changes may be made therein without departing from the clear teaching of the disclosure. Accordingly, reference should be made to the appended claims in determining the full scope.

What is claimed is:

1. A process for making a blank for a display case comprising:

modifying a basic blank having a central bottom panel having an upper surface, a lower surface and four generally rectilinear sides which intersect at perpendicular corners, a front panel separated from, and coextensive with, a first of said sides by a first scoreline, a rear panel opposite said front panel and separated by, and coextensive with, a second scoreline from a second of said sides, a first side panel, separated from a third of said sides by a third scoreline, said third scoreline being generally perpendicular to said first scoreline, said first side panel including lateral scorelines generally perpendicular to said third scoreline separating said first side panel from an attachment panel in each side thereof, and a second side panel separated from a fourth side of said central bottom panel by a fourth scoreline, said fourth scoreline being opposite said third scoreline, said second side panel including second side panel lateral scorelines generally perpendicular to the fourth scoreline separating said second side panel from an attachment panel on each side thereof, by adding a further scoreline at each attachment flap and by cutting away one or more of the perpendicular corners of the bottom panel to provide at least five generally rectilinear sides and thereby shorten one or more of the first and second sides and by cutting away portions of at least one of the front and rear flaps so that it is coextensive with the shortened side to which it is attached.

2. The process according to claim 1 wherein said central bottom panel has eight sides.

* * * * *